US006827596B2

(12) United States Patent
Hori

(10) Patent No.: US 6,827,596 B2
(45) Date of Patent: Dec. 7, 2004

(54) CONNECTOR

(75) Inventor: Takayuki Hori, Aichi (JP)

(73) Assignee: J.S.T. Mfg. Co., Ltd., Osaka (JP)

( * ) Notice: Subject to any disclaimer, the term of this patent is extended or adjusted under 35 U.S.C. 154(b) by 0 days.

(21) Appl. No.: 10/831,084

(22) Filed: Apr. 23, 2004

(65) Prior Publication Data

US 2004/0214470 A1 Oct. 28, 2004

(30) Foreign Application Priority Data

Apr. 25, 2003 (JP) ..... 2003-122315

(51) Int. Cl.[7] ..... H01R 29/00
(52) U.S. Cl. ..... 439/188; 439/489
(58) Field of Search ..... 439/188, 353, 439/354, 356, 357, 489

(56) References Cited

U.S. PATENT DOCUMENTS 5,562,486 A * 10/1996 Saijo et al. ..... 439/489
5,667,403 A * 9/1997 Fukuda et al. ..... 439/489
5,743,760 A * 4/1998 Inaba et al. ..... 439/489
5,803,756 A * 9/1998 Furutani et al. ..... 439/188
5,997,344 A * 12/1999 Shinozaki ..... 439/489
6,422,894 B1 * 7/2002 Endo et al. ..... 439/489

FOREIGN PATENT DOCUMENTS

JP 2001-196134 A 7/2001 ..... H01R/13/64

* cited by examiner

*Primary Examiner*—Thanh-Tam Le
(74) *Attorney, Agent, or Firm*—Osha & May L.L.P.

(57) ABSTRACT

A connector includes a male connector housing and a female connector housing having therein a fitting detector member. The fitting detector member includes a fitting detector terminal to be brought into contact with a short-circuit terminal disposed within the male connector housing when the female connector housing is completely fitted with the male connector housing; and a locking member having an engaging portion with the male connector housing. These components are formed separately from the female connector housing. The locking member made of resin is fixed to the fitting detector terminal made of metal. The locking member is displaced together with the fitting detector terminal in the process of the fitting operation of the female connector housing with the male connector housing.

6 Claims, 8 Drawing Sheets

CONNECTOR

BACKGROUND OF THE INVENTION

1. Field of the Invention

The present invention relates to a connector having terminals for detecting fitting of a female connector housing with a male connector housing.

2. Description of Related Art

JP-A-2001-196134 discloses a connector in which fitting of a female connector housing with a male connector housing is detected with a pair of short-circuit terminals provided in the male connector housing and a fitting detector terminal provided in the female connector housing. In the connector, when the female connector housing has been completely fitted with the male connector housing, the short-circuit terminals are in contact with the fitting detector terminal to form a closed circuit, whereby fitting of the female connector housing in the male connector housing is detected.

In the female connector housing formed is a locking arm having an engaging portion to engage with an engaging portion of the male connector housing. The locking arm is formed as a cantilever having its rear end being supported and its front end being free. Here, "rear end" is the end of the locking arm opposite to the direction in which the locking arm gets near to the male connector housing in the process of the fitting operation (hereinafter, the direction will be referred to as "fitting direction"), and "front end" is the end of the locking arm in the fitting direction. The locking arm is elastically vertically deformable in the vicinity of the front end. In the process of the fitting operation, the vicinity of the front end of the locking arm is pressed by part of the male connector housing so as to be displaced downward with the rear end of the locking arm functioning as a fulcrum. As the male and female connector housings are further brought near to each other, the portion of the locking arm returns upward to engage with the engaging portion of the male connector housing. This engagement accomplishes fitting of the female connector housing with the male connector housing.

The fitting detector terminal is made of a bent metal plate. The fitting detector terminal is disposed within a recess below the locking arm such that the bent portion of the fitting detector terminal is in the rear. The upper part of the bent fitting detector terminal can act as an elastic portion of a cantilever structure having its rear end being supported and its front end being free, like the locking arm. The elastic portion can move together with the locking arm. At the same time when the locking arm returns upward, the elastic portion also returns upward to come into contact with the short-circuit terminal within the male connector housing.

If the vicinity of the front end of the locking arm is easy to be displaced downward, fitting may be cancelled when the female connector housing receives force opposite to the fitting direction, for example, because an electric wire of a female terminal provided on the female connector housing is pulled. In the connector having the above construction, therefore, to surely hold fitting of the female connector housing with the male connector housing, the vicinity of the front end of the locking arm including the engaging portion is preferably hard to be displaced downward. However, the vicinity of the front end of the locking arm hard to be displaced downward may bring about a problem that the fitting operation of the female connector housing with the male connector housing can not be smoothly performed.

It is desired to improve the fitting holding power without deteriorating the fitting operability. In the connector having the above construction, however, such improvement can not easily be realized because adjustment of strength or rigidity of the locking arm formed integrally with the female connector housing is difficult.

SUMMARY OF THE INVENTION

An object of the present invention is to provide a connector having terminals for detecting fitting of a female connector housing with a male connector housing, wherein the fitting holding power can be improved without deteriorating the fitting operability.

According to an aspect of the present invention, a connector comprises a male connector housing, a female connector housing that can be fitted with the male connector housing, a short-circuit terminal made of a conductive material and provided in one of the male and female connector housings, and a fitting detector terminal made of a conductive material and provided in the other of the male and female connector housings. The fitting detector terminal is displaced in a process of a fitting operation of the female connector housing with the male connector housing and comes into contact with the short-circuit terminal to form a closed circuit when the female connector housing is completely fitted with the male connector housing. The connector further comprises a locking member formed as a component separate from either of the male and female connector housings. The locking member is fixed to the fitting detector terminal and placed in the other of the male and female connector housings. The locking member is displaced together with the fitting detector terminal in the process of the fitting operation. The locking member can engage with the one of the male and female connector housings when the female connector housing is completely fitted with the male connector housing.

According to the invention, the locking member that is displaced in the process of the fitting operation and engages with one of the male and female connector housings to realize fitting is not formed integrally with any housing. The locking member is formed as a component separate from either of the male and female connector housings and fixed to the fitting detector terminal. Therefore, in comparison with a case wherein the locking member is formed integrally with one of the male and female connector housings, improvement of the fitting holding power can be easily realized without deteriorating the fitting operability.

BRIEF DESCRIPTION OF THE DRAWINGS

Other and further objects, features and advantages of the invention will appear more fully from the following description taken in connection with the accompanying drawings in which.

DESCRIPTION OF THE PREFERRED EMBODIMENT

Figure 1:
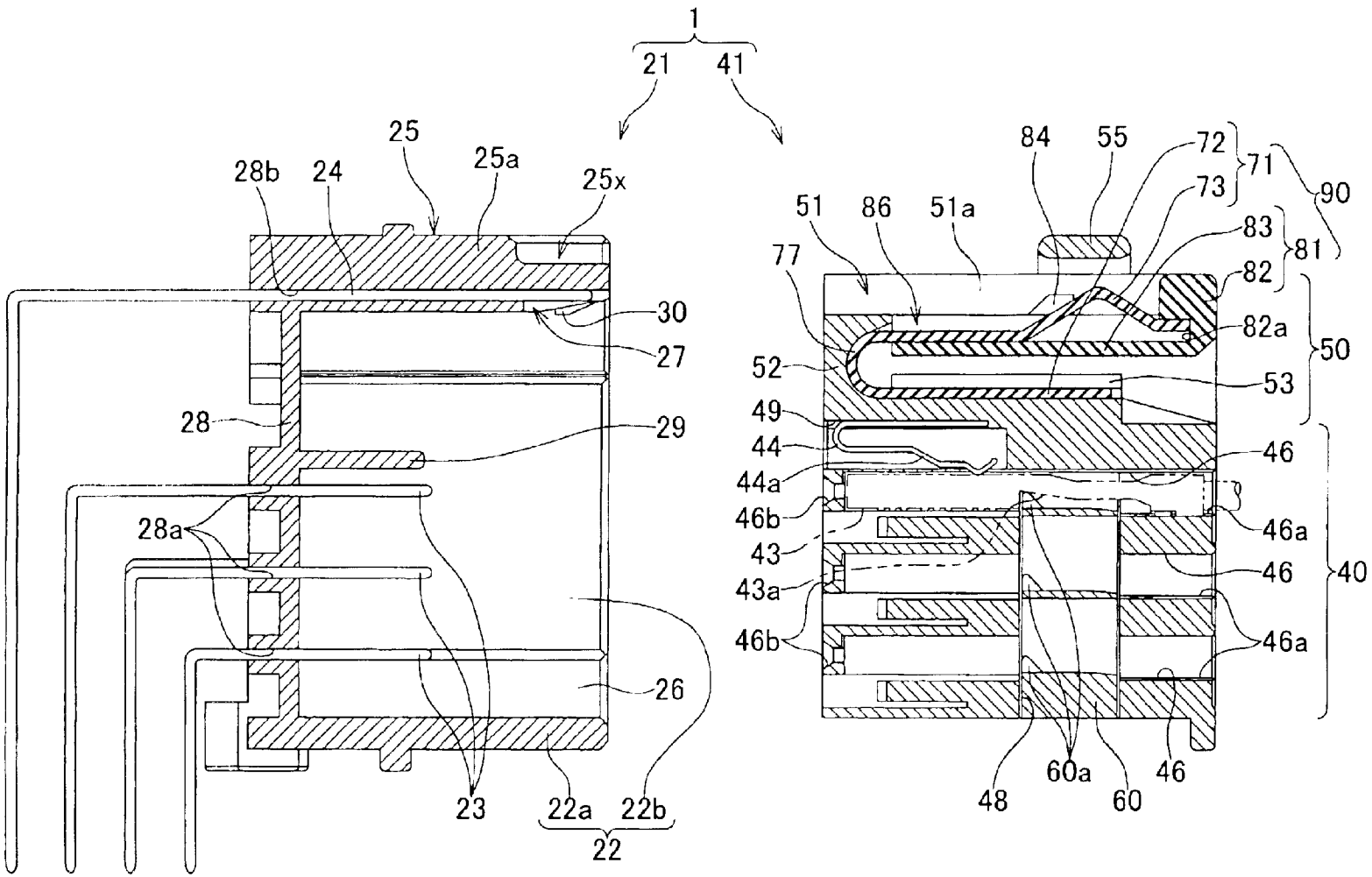
FIG. 1 is a sectional view of male and female connector housings of a connector according to an embodiment of the present invention, in a state wherein the female connector housing has not yet been fitted with the male connector housing.
Figure 3:
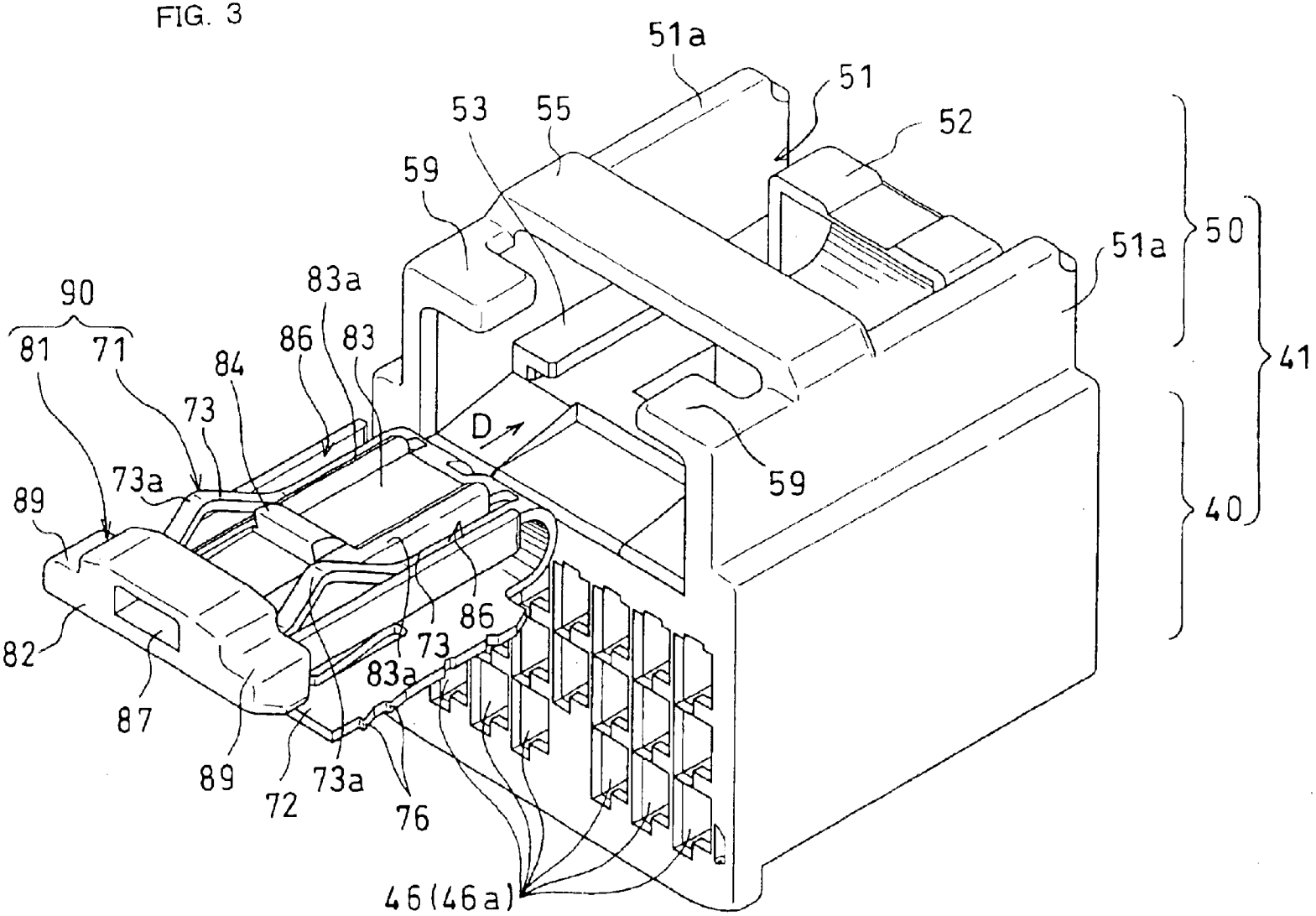
FIG. 3 is a general perspective view of the female connector housing of FIG. 2B, in a state wherein the fitting detector member is going to be installed.

Hereinafter, the construction of a connector according to an embodiment of the present invention will be described. As illustrated in FIG. 1, the connector 1 of this embodiment includes a male connector housing 21 and a female connector housing 41 having therein a fitting detector member 90 as illustrated in FIG. 3.

In the below description, the direction in which the male or female connector housing 21 or 41 is relatively moved to approach the female or male connector housing 41 or 21 in the process of fitting the female connector housing 41 with the male connector housing 21 is referred to as "fitting direction". That is, in FIG. 1, the fitting direction is the right of the male connector housing 21 or the left of the female connector housing 41. In addition, the fitting direction may be referred to as "front" and the direction opposite to the fitting direction may be referred to as "rear". Further, the upside and downside in FIG. 1 are referred to as "upper" and "lower", respectively. The upside and downside in a plane vertical to the plane of FIG. 1 are referred to as "left" and "right", respectively.

First, the construction of the male connector housing 21 will be described with reference to FIGS. 1 and 2A.

The male connector housing 21 is made of resin. The male connector housing 21 includes a bottom wall 28 vertical to the fitting direction, a hood 22 for female connector housing, and a hood 25 for detector member. The female connector housing hood 22 and the detector member hood 25 are formed on the bottom wall 28 so as to protrude frontward.

In the lower half region of the bottom wall 28, twenty-three through-holes 28*a* are formed each of which allows a male terminal 23 to pass through. The through-holes 28*a* are arranged vertically in three rows and horizontally in eight rows so as to avoid a region where a partition 26 as described later is disposed. Each through-hole 28*a* has a substantially square cross-section.

Each male terminal 23 is made of metal. Each male terminal 23 has a substantially square cross-section somewhat smaller than that of each through-hole 28*a*. Each male terminal 23 is nearly L-shaped as the whole. One end of each male terminal 23 is within the female connector housing hood 22. Each male terminal 23 extends from the one end opposite to the fitting direction and passes through the corresponding through-hole 28*a*. Each male terminal 23 is bent downward behind the bottom wall 28. The other end of each male terminal 23 is fixed to a non-illustrated substrate.

Figure 2B:
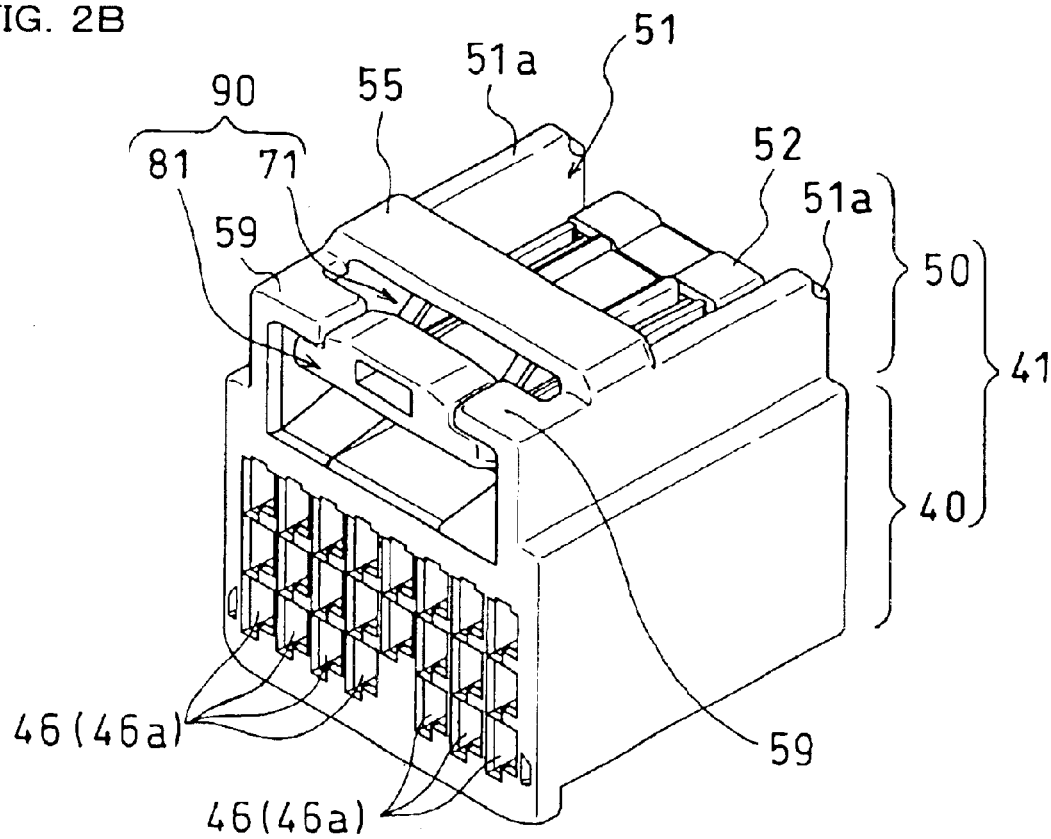
FIG. 2B is an oblique rear perspective view of the female connector housing of the connector of FIG. 1, having therein a fitting detector member.
Figure 2A:
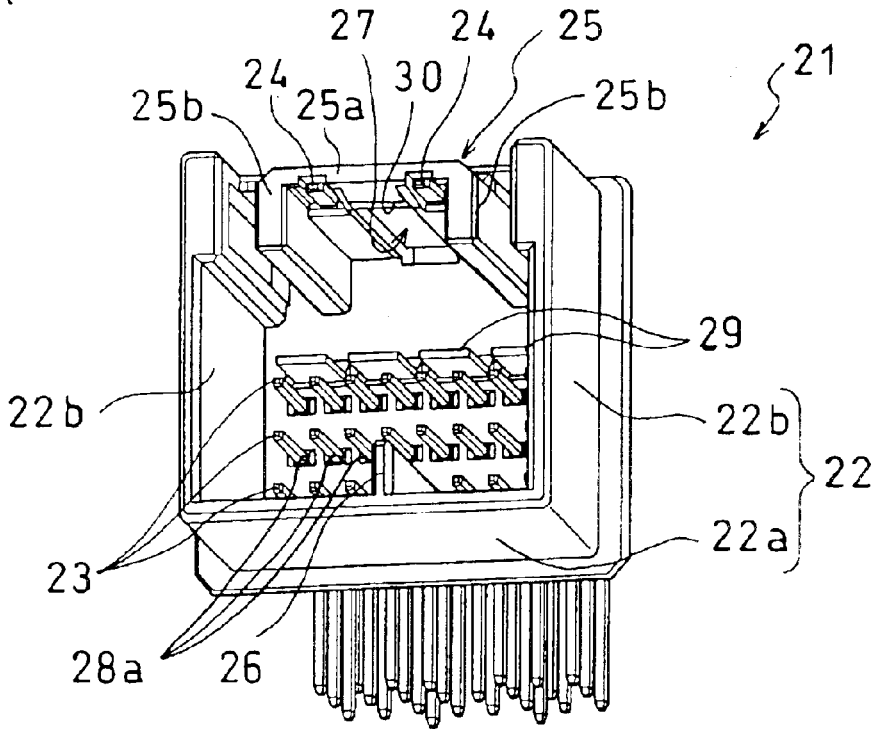
FIG. 2A is a front perspective view of the male connector housing of the connector of FIG. 1.

As illustrated in FIG. 2A, the female connector housing hood 22 is made up of a lower wall 22*a* vertical to the bottom wall 28, and two side walls 22*b* extending upward from both ends of the lower wall 22*a*. The space surrounded by the lower and side walls 22*a* and 22*b* receives therein the female connector housing 41. A portion of each side wall 22*b* in the vicinity of the upper end of the side wall 22*b*, which portion is opposite to the detector member hood 25, is thicker than the other portion of the side wall 22*b*.

Substantially at the horizontal center of the lower wall 22*a* of the female connector housing hood 22, a partition 26 is provided to extend upward from the lower wall 22*a*. The region where the partition 26 is disposed corresponds to one through-hole 28*a* for inserting a male terminal 23, as described above.

In the upper portion of the region in the bottom wall 28 where the through-holes 28*a* are formed, releasing plates 29 are provided to protrude frontward. Each releasing plate 29 is for isolating a female terminal 43 and a short-circuit terminal 44, as described later, from each other. As illustrated in FIG. 1, the length of each protruding releasing plate 29 is substantially half the length of the female connector housing hood 22 in the fitting direction. AS illustrated in FIG. 2A, each releasing plate 29 has a substantially rectangular cross-section of an oblong shape. Although FIG. 1 shows only one releasing plate 29, four releasing plates 29 are arranged in a row vertical to FIG. 1.

The detector member hood 25 is made up of an upper wall 25*a* parallel to the lower wall 22*a* of the female connector housing hood 22, and two side walls 25*b* extending downward from both ends of the upper wall 25*a*. Each side wall 25*b* is at a distance from the corresponding side wall 22*b* of the female connector housing hood 22. The space between each pair of side walls 25*b* and 22*b* receives a side wall 51*a* in the upper portion of the female connector housing 41 as described later (see FIG. 2B).

As illustrated in FIG. 2A, a groove 27 extending in the fitting direction is formed in the vicinity of the center of the lower face of the upper wall 25*a*. A protrusion 30 is formed in front of the groove 27. As illustrated in FIG. 1, the protrusion 30 protrudes downward and has a face inclined rearward. The protrusion 30 can engage with a projection (engagement portion) 84 of a locking member 81 as described later.

Near the lower face of the upper wall 25*a*, through-holes 28*b* each allowing a short-circuit terminal 24 to pass through are formed on both sides of the groove 27. Each through-hole 28*b* extends opposite to the fitting direction, further extends through the bottom wall 28, and is open at the rear face of the bottom wall 28. Each through-hole 28*b* has a substantially rectangular cross-section of an oblong shape. Although FIG. 1 shows only one through-hole 28*b*, two through-holes 28*b* are arranged vertically to FIG. 1, that is, a pair of right and left through-holes 28*b* are provided as illustrated in FIG. 2A.

Each short-circuit terminal 24 is made of metal. Each short-circuit terminal 24 has a substantially square cross-section somewhat smaller than the cross-section of each through-hole 28*b*. As illustrated in FIG. 1, each short-circuit terminal 24 is nearly L-shaped as the whole, like each male terminal 23. One end portion of each short-circuit terminal 24 extends in the fitting direction within the corresponding through-hole 28*b*. Each short-circuit terminal 24 is bent downward behind the bottom wall 28. The other end of each short-circuit terminal 24 is fixed to the non-illustrated substrate, like each male terminal 23. The other end of each short-circuit terminal 24 is thereby connected to a non-illustrated electric circuit so that a closed circuit is formed when the short-circuit terminal 24 is in contact with a fitting detector terminal 71 as described later. The one end portion of each short-circuit terminal 24 extends in the vicinity of the front end of the upper wall 25*a*, where the one end of the short-circuit terminal 24 is exposed because the lower face of the front end of the upper wall 25*a* is partially cut away, as illustrated in FIG. 2A.

As illustrated in FIG. 1, in the upper face of the front end of the upper wall 25*a*, a recess 25*x* for receiving therein a connecting member 55 of the female connector housing 41 as described later is formed to extend horizontally.

Next, the construction of the female connector housing 41 will be described with reference to FIGS. 1, 2B, and 3.

The female connector housing 41 is made of resin, like the male connector housing 21. As illustrated in FIG. 2B, the female connector housing 41 is made up of a female terminal accommodating portion 40 having a substantially rectangular parallelepiped shape, and a detector member accommodating portion 50 provided on the female terminal accommodating portion 40.

In the female terminal accommodating portion 40, twenty-three cavities 46 are formed for accommodating female terminals 43 as illustrated with alternate long and two short dashes line in FIG. 1. The cavities 46 correspond to the respective through-holes 28*a* of the male connector housing 21 as illustrated in FIG. 2A. Each cavity 46 has a rectangular parallelepiped shape slender in the fitting direction. As illustrated in FIG. 1, each cavity 46 is open at both of the front and rear faces of the female terminal accommodating portion 40. The front opening of each cavity 46 is made into a male terminal insertion port 46*b* through which the corresponding male terminal 23 is inserted. The rear opening of each cavity 46 functions as a female terminal insertion port 46*a* through which the corresponding female terminal 43 is inserted. Each male terminal insertion port 46*b* has an opening area smaller than that of each female terminal insertion port 46*a*.

As illustrated in FIG. 1, in the lower face of the female terminal accommodating portion 40, a retainer insertion port 48 is formed through which a retainer 60 is inserted. A retainer insertion portion extends upward from the retainer insertion port 48 at the lower face of the female terminal accommodating portion 40, through substantially the central portions in the lengths of the vertically arranged cavities 46. When the retainer 60 is inserted in the retainer insertion portion, protrusions 60*a* provided on the retainer 60 engage with notches 43*a* provided in the lower faces of the respective female terminals 43 substantially at the centers of the lengths of the female terminals 43, so that the female terminals 43 are prevented from being drawn out.

A space 49 for accommodating therein short-circuit terminals 44 is provided in a front portion of the female connector housing 41 immediately above the uppermost cavities 46 of the female terminal accommodating portion 40. The space 49 is open at the front face of the female connector housing 41.

Figure 7:
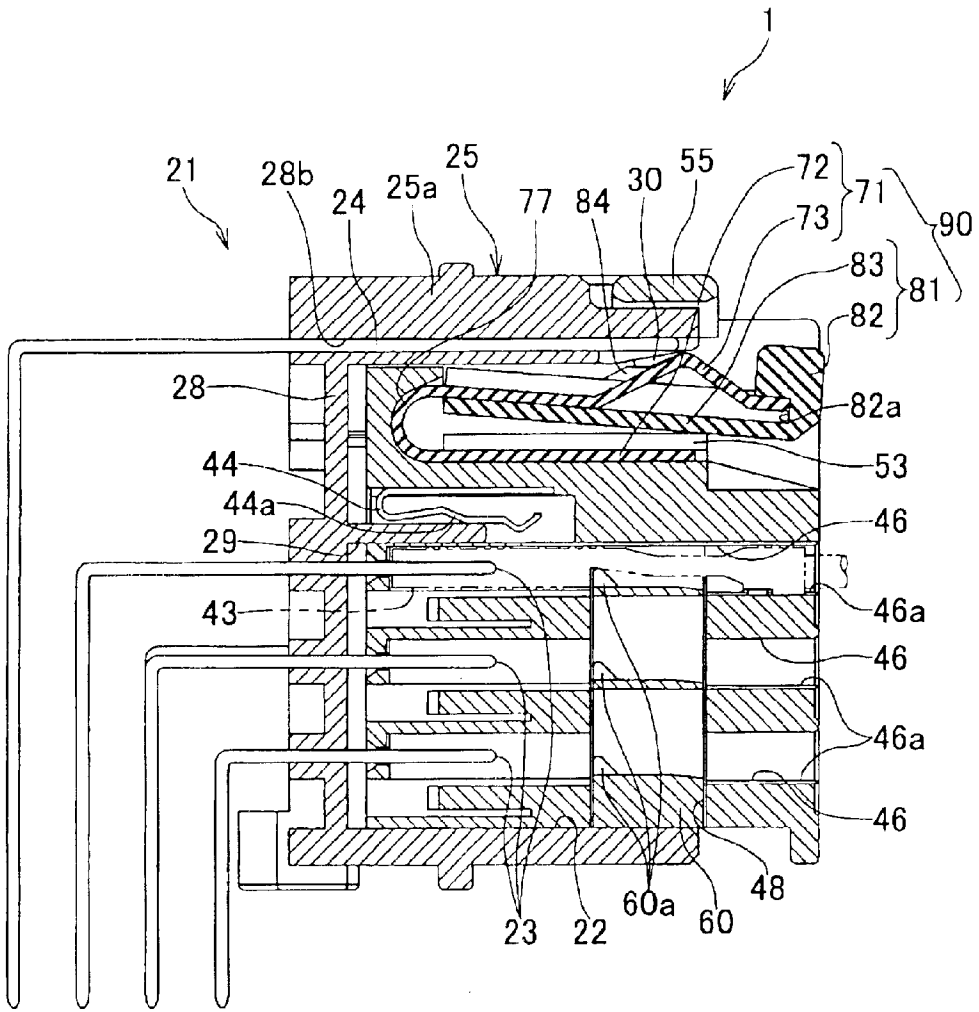
FIG. 7 is a sectional view of the male and female connector housings of FIG. 1 in a second step of the fitting operation.
Figure 8:
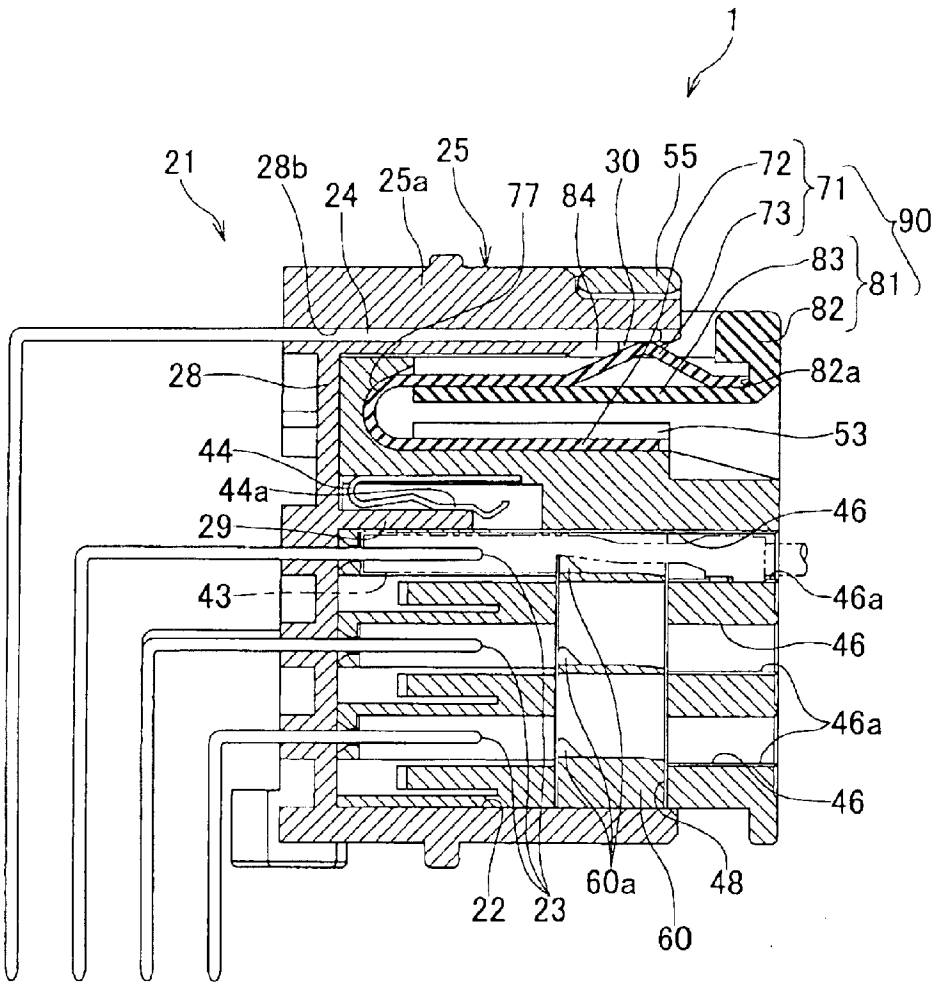
FIG. 8 is a sectional view of the male and female connector housings of FIG. 1 after the fitting operation is completed.

Each short-circuit terminal 44 is made of a bent metal plate. Although FIG. 1 shows only one short-circuit terminal 44, a pair of right and left short-circuit terminals 44 are provided. The lower part of each bent short-circuit terminal 44 can act as an elastic portion 44*a* elastically vertically deformable, of a cantilever structure having its front end bent portion being supported and its rear end being free. In the state of FIG. 1, the vicinities of the distal ends of the pair of elastic portions 44*a* are in contact with the upper faces of the pair of right and left female terminals 43 immediately below the space 49 so as to interconnect the female terminals 43. As will be described later in detail, in the process of the fitting operation of the female connector housing 41 with the male connector housing 21, when each releasing plate 29 of the male connector housing 21 is inserted in the space 49 and interposed between the elastic portion 44*a* of the short-circuit terminal 44 and the female terminal 43 in the corresponding pair, the elastic portion 44*a* and the female terminal 43 are isolated from each other, as illustrated in FIGS. 7 and 8.

As illustrated in FIGS. 2B and 3, the detector member accommodating portion 50 of the female connector housing 41 is made up of two side walls 51*a* extending vertically from the female terminal accommodating portion 40 and horizontally in the fitting direction; a pair of protrusions 59 formed on the upper ends of the respective side walls 51*a* in the rear portions of the side walls 51*a* (in the oblique left portions in FIGS. 2B and 3) so as to be opposed to each other; an interconnecting portion 55 provided at a short distance from the front faces of the protrusions 59, for interconnecting the upper ends of the side walls 51*a*; and so on. The side walls 51*a*, the interconnecting portion 55, and the protrusions 59 define a space 51, wherein a fitting detector member 90 is accommodated.

As illustrated in FIG. 1, in a front portion of the detector member accommodating portion 50 above the space 49, a detector terminal hood 52 is provided for receiving the bent portion 77 of a fitting detector terminal 71 as described later. As illustrated in FIG. 3, the hood 52 is hollow box-shaped having its rear face being open. The inner surface of the hood 52 is curved so as to correspond to the curve of the bent portion 77 of the fitting detector terminal 71, as illustrated in FIG. 1.

As illustrated in FIG. 3, in the lower portion of the space 51, a pair of right and left detector terminal supporting portions 53 are provided for supporting both projecting side portions of the base 72 of the fitting detector terminal 71 as described later, though FIG. 3 shows only one detector terminal supporting portion 53. Each supporting portion 53 is L-shaped in cross-section. The supporting portions 53 are disposed along the inner surfaces of the lower portions of the respective side walls 51*a*. Because the pair of supporting portions 53 supports both projecting side portions of the base 72, the base 72 can be kept horizontal. Therefore, a fitting detector member 90 can be adequately assembled in the female connector housing 41.

Next, the construction of a fitting detector member 90 to be inserted in the female connector housing 41 will be described with reference to FIGS. 4 and 5. The fitting detector member 90 is made up of a fitting detector terminal 71 and a locking member 81, which are assembled into the fitting detector member 90.

The fitting detector terminal 71 is made of a bent metal plate. As illustrated in FIG. 4, the fitting detector terminal 71 is made up of a base 72 substantially rectangular in plane, a locking member supporting portion 74, and a pair of right and left elastic portions 73. The locking member supporting portion 74 and the elastic portions 73 are connected to the base 72 through a bent portion 77. The locking member supporting portion 74 and the elastic portions 73 are disposed above the base 72 to be opposed to the base 72.

Both side portions in the width of the base 72 are projected outward. Protrusions 76 are formed on the end face of each side portion. When the fitting detector member 90 is assembled in the female connector housing 41, each protrusion 76 engages with the inner surface of the corresponding detector terminal supporting portion 53 provided in the female connector housing 41 as illustrated in FIG. 3, so that the fitting detector member 90 is prevented from being drawn out from the female connector housing 41.

The locking member supporting portion 74 has a substantially rectangular shape tapered frontward, in plane. The supporting portion 74 has a cantilever structure in which the bent portion 77 is supported and the distal end is free. Also on both end faces of the supporting portion 74 in the width of the supporting portion 74, protrusions 75 are formed like the protrusions 76 formed on the base 72. When the fitting detector terminal 71 and the locking member 81 are assembled, each protrusion 75 engages with the inner surface of a supporting portion insertion hole 88, as shown with broken lines in FIG. 4, of the locking member 81 as described later, so that the fitting detector terminal 71 and the locking member 81 are prevented from being separated from each other.

Each elastic portion 73 has a cantilever structure in which the bent portion 77 is supported and the distal end is free, like the locking member supporting portion 74. Each elastic portion 73 is elastically vertically deformable. The vicinity of the distal end of each elastic portion 73 is made into an inversed V-shape protruding upward. As will be described later in detail, the upper face of the V-shaped portion is brought into contact with the corresponding short-circuit terminal 24 of the male connector housing 21.

The locking member 81 is made of resin. The locking member 81 is made up of an operation portion 82 to be held by an operator, and a main body 83 extending frontward, i.e., obliquely rightward in FIGS. 4 and 5, from the operation portion 82.

At the center of the operation portion 82, an operation hole 87 is formed so as to extend through the operation portion 82 along the length of the locking member 81. The operator can insert his finger into the operation hole 87 to manipulate the locking member 81. Both end portions 89 in the length of the operation portion 82 are partially cut away to engage with a pair of protrusions 59 of the female connector housing 41.

Figure 4:
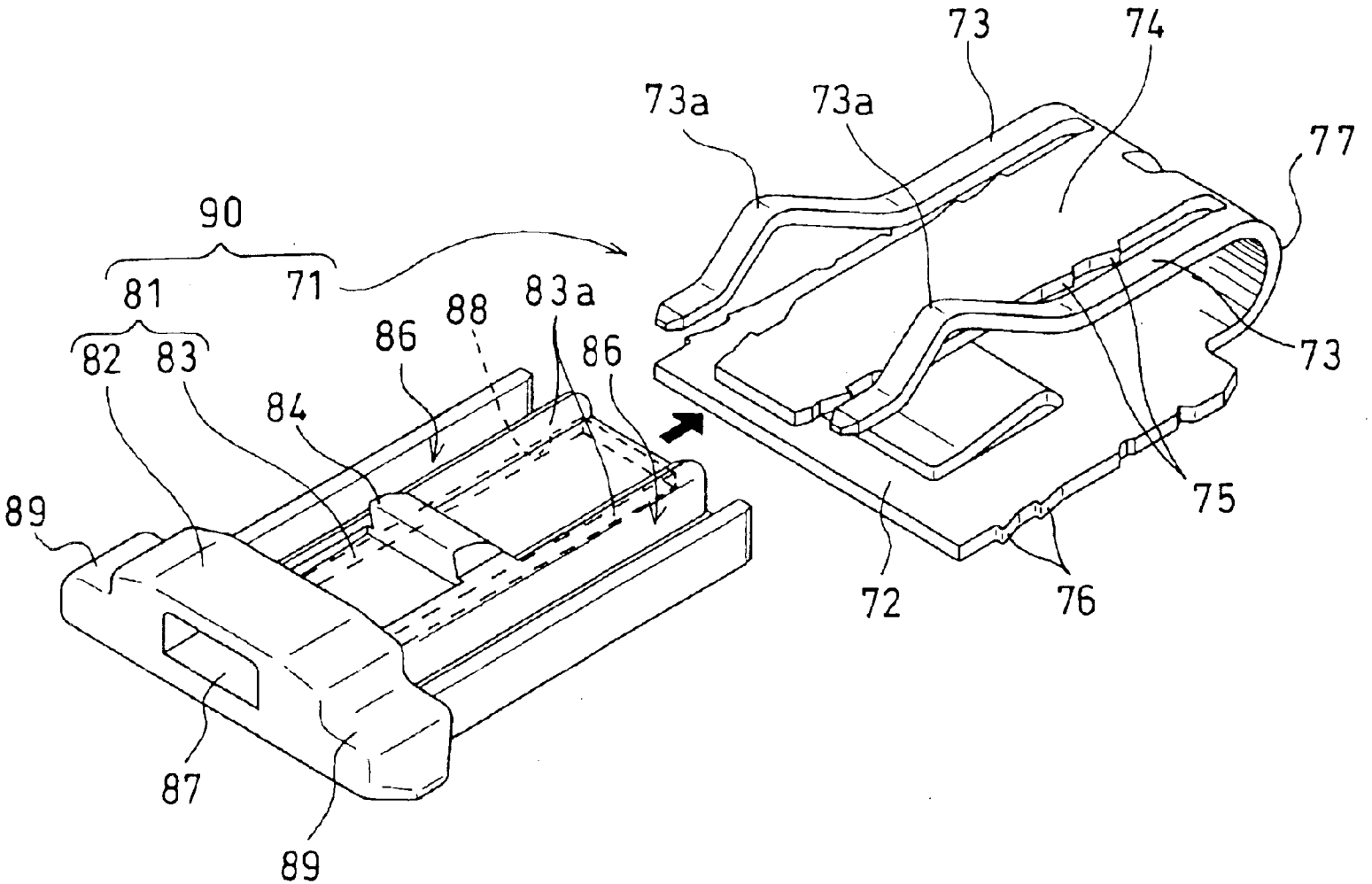
FIG. 4 is a general perspective view of the fitting detector member to be installed in the female connector housing of FIG. 2B, in a state wherein a fitting detector terminal and a locking member are separated from each other.

In the operation portion 82, at the portions corresponding to grooves 86, as illustrated in FIGS. 1 and 4, of the main body 83 as described later, recesses 82*a* are formed for receiving therein the distal ends of the elastic portions 73 of the fitting detector terminal 71. As apparent from FIG. 1, each recess 82*a* is larger than the thickness of each elastic portion 73 so that the distal end of the elastic portion 73 can move vertically within the recess 82*a*.

As illustrated in FIG. 4, in the main body 83, a pair of right and left grooves 86 is formed so as to extend in the fitting direction, for receiving therein the respective elastic portions 73 of the fitting detector terminal 71. In the main body 83, protruding stripes 83*a* protruding upward are formed inside the grooves 86. Further, inside the protruding stripes 83*a*, a protrusion 84 that can engage with the protrusion 30 of the male connector housing 21 as described before is formed substantially at the center of the length of the main body 83. The protrusion 84 protrudes upward and has a face inclined rearward like the protrusion 30 of the male connector housing 21. Within the main body 83, a supporting portion insertion hole 88 for receiving therein the supporting portion 74 of the fitting detector terminal 71 is formed so as to be open at the face of the main body 83 opposite to the operation portion 81.

Because the protrusion 30 of the male connector housing 21 and the protrusion 84 of the locking member 81 have the inclined faces of the same inclination angle, engagement between the protrusions 30 and 84 can be smoothly performed by sliding the inclined faces on each other, as described later. In addition, the downward displacement of the fitting detector terminal 71 at this time can be not rapid but gradual.

To assemble the fitting detector terminal 71 and the locking member 81, the locking member 81 is brought near to the fitting detector terminal 71 in the direction of an arrow in FIG. 4. The supporting portion 74 of the fitting detector terminal 71 is inserted into the supporting portion insertion hole 88 of the locking member 81 and each elastic portion 73 of the fitting detector terminal 71 is slid in the corresponding groove 86 of the locking member 81. When the supporting portion 74 is completely inserted to the innermost portion of the insertion hole 88, the distal end of each elastic portion 73 is within the corresponding recess 82*a* of the locking member 81 as illustrated in FIG. 1.

Figure 5:
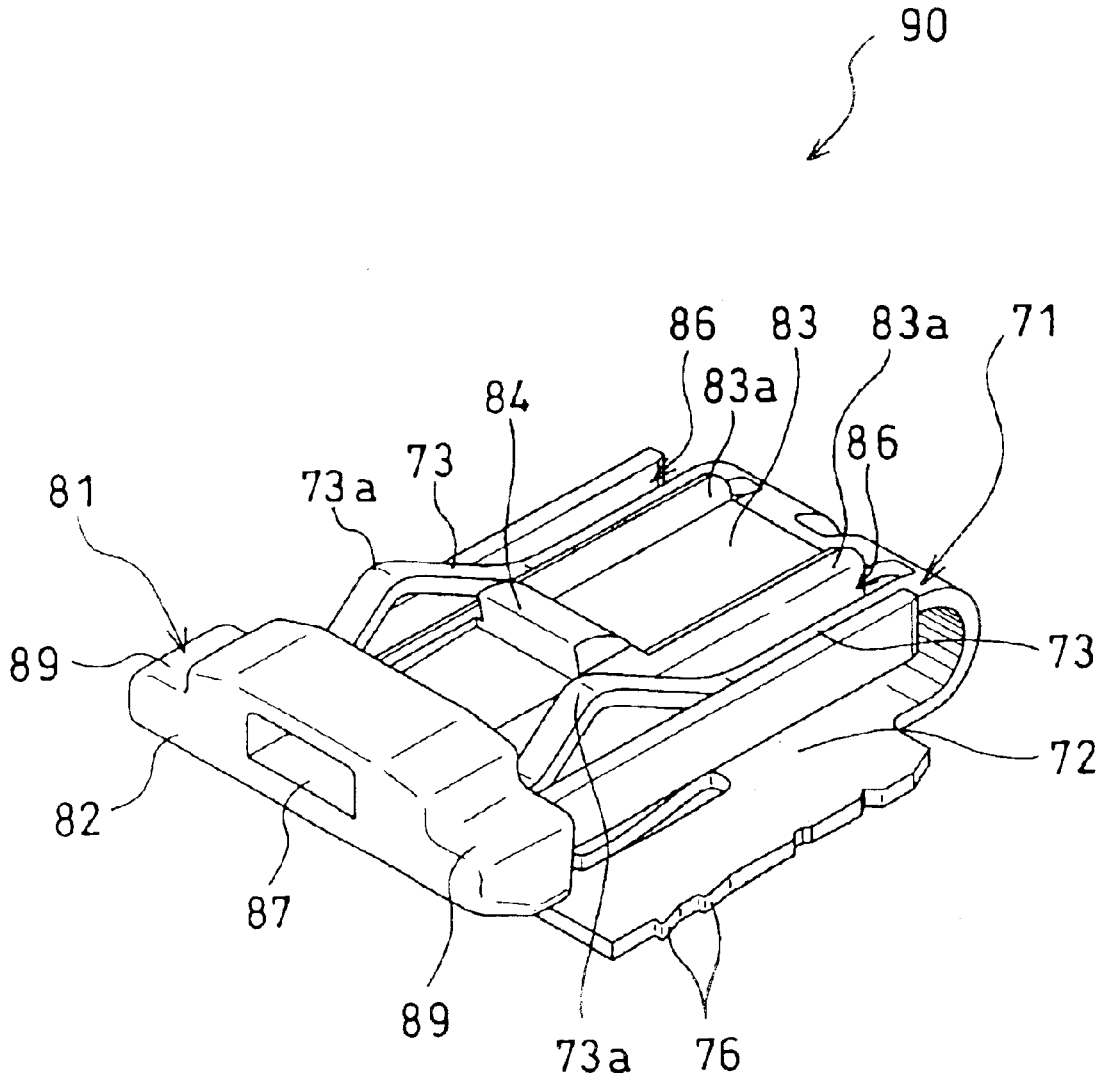
FIG. 5 is a general perspective view of the fitting detector member in a state wherein the fitting detector terminal and the locking member of FIG. 4 have been assembled.

In the fitting detector member 90 of FIG. 5 obtained by assembling the fitting detector terminal 71 and the locking member 81 as described above, the locking member 81 is supported by the supporting portion 74 of the fitting detector terminal 71 as illustrated in FIG. 4. In addition, in the locking member 81, a pair of elastic portions 73 of the fitting detector terminal 71 are supported from both of right and left sides within a pair of grooves 86 formed in the main body 83 of the locking member 81.

To install the fitting detector member 90 in the female connector housing 41, the fitting detector member 90 is inserted into the space 51 of the female connector housing 41 in the direction of an arrow in FIG. 3. First, both projecting side portions of the base 72 of the fitting detector terminal 71 are inserted into the detector terminal supporting portions 53 of the female connector housing 41. With somewhat pressing the operation portion 82 of the locking member 81 downward, the fitting detector member 90 is slid in the fitting direction. The bent portion 77 of the fitting detector terminal 71 is inserted into the hood 52 of the female connector housing 41. With engaging both end portions 89 of the operation portion 82 of the locking member 81 with a pair of protrusions 59 of the female connector housing 41, the operation portion 82 is disposed between the protrusions 59 and both side walls 51*a*.

When the fitting detector member 90 is completely installed in the female connector housing 41, the interconnecting member 55 of the female connector housing 41 is opposed to the V-shaped portions of the elastic portions 73 of the fitting detector terminal 71, as illustrated in FIGS. 1 and 2B. In other words, the interconnecting member 55 covers the V-shaped portions of the elastic portions 73 with being kept at a vertical distance from the V-shaped portions.

The locking member 81 is inclined upward before the fitting detector member 90 is installed in the female connector housing 41. However, when the fitting detector member 90 is installed in the female connector housing 41, the locking member 81 is horizontal as illustrated in FIG. 1 because the operation portion 82 is pressed downward and both end portions 89 of the operation portion 82 are engaged with the protrusions 59 of the female connector housing 41. In this state, the locking member 81 is being biased upward by the elastic force of the supporting portion 74.

At this time, the distal end of each elastic portion 73 of the fitting detector terminal 71 is in contact with the upper end of the corresponding recess 82*a* of the locking member 81.

Next, process of fitting the female connector housing 41 with the male connector housing 21 will be described with reference to FIGS. 6, 7, and 8.

First, the male and female connector housings 21 and 41 are opposed to each other as illustrated in FIG. 1. In this state, the male or female connector housing 21 or 41 is relatively moved in the fitting direction to approach the female or male connector housing 41 or 21. The inclined face of the protrusion 30 of the male connector housing 21 thereby comes into contact with the inclined face of the protrusion 84 of the locking member 81. The male or female connector housing 21 or 41 is further relatively moved in the fitting direction and the inclined face of the protrusion 30 slides on the inclined face of the protrusion 84 of the locking member 81. The locking member 81 then receives downward pressure from the protrusion 30 to be displaced downward, as illustrated in FIG. 6. At this time, the supporting portion 74 of the fitting detector terminal 71 supporting the locking member 81 and the elastic portions 73 of the fitting detector terminal 71 each distal end of which is being held by the locking member 81 also receive downward force so that the supporting portion 74 and the elastic portions 73 are displaced downward with the bent portion 77 functioning as a fulcrum. In this manner, because the elastic portions 73 of the fitting detector terminal 71 are not brought into contact with any portion of the male connector housing 21, the operation can be smoothly performed.

Figure 6:
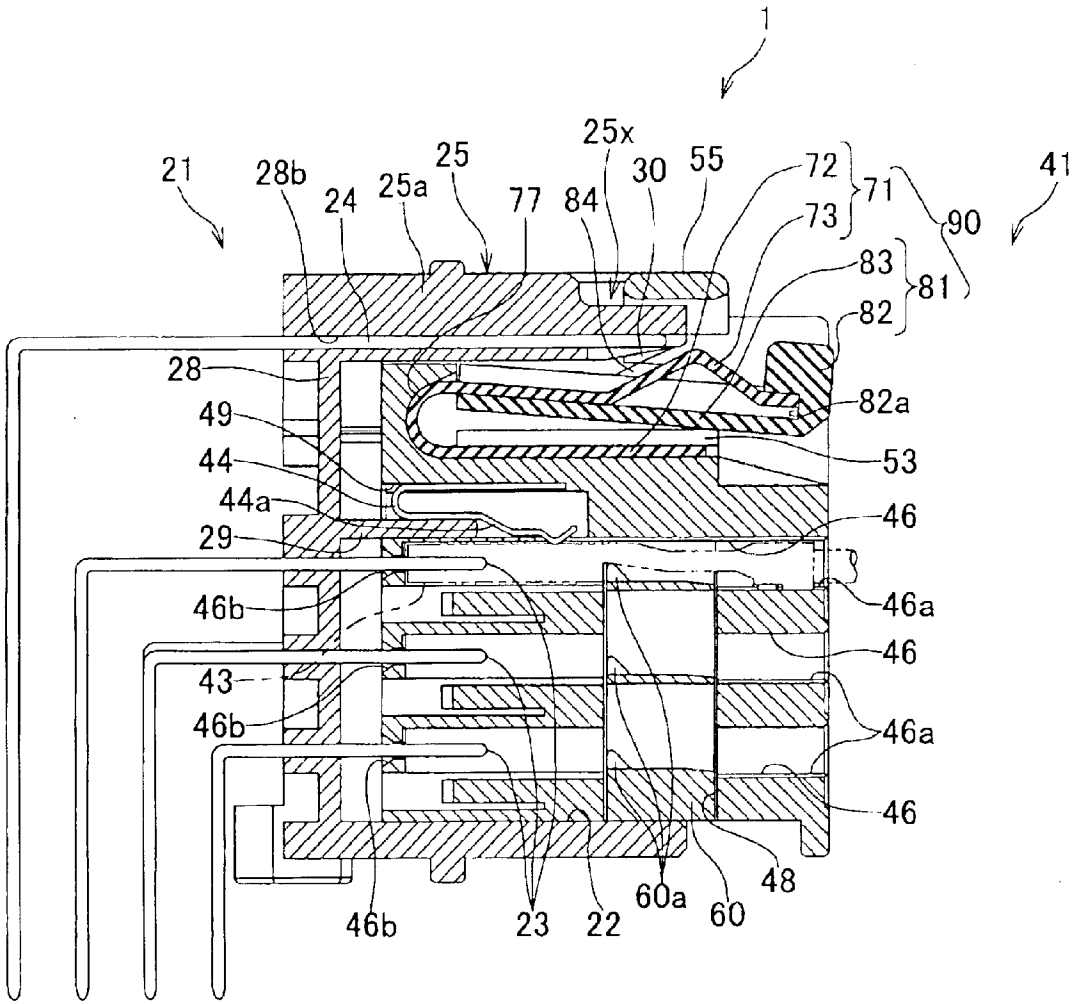
FIG. 6 is a sectional view of the male and female connector housings of FIG. 1 in a first step of the fitting operation.

In the state of FIG. 6, each male terminal 23 of the male connector housing 21 has been inserted into the corresponding cavity 46 of the female connector housing 41 through the corresponding male connector insertion port 46*b* to be connected to the corresponding female terminal 43. The releasing plates 29 formed within the male connector housing 21 have been inserted into the space 49 in the female connector housing 41. In this state, the releasing plates 29 have not yet reached the positions of the elastic portions 44*a* of the short-circuit terminals 44.

The male or female connector housing 21 or 41 is further relatively moved in the fitting direction, as illustrated in FIG. 7. The releasing plates 29 are then brought into contact with the elastic portions 44*a* of the short-circuit terminals 44 and interposed between the elastic portions 44*a* and the corresponding male terminals 43. Each elastic portion 44*a* is thereby isolated from the corresponding male terminal 43.

In either state of FIGS. 6 and 7, because the elastic portions 73 of the fitting detector terminal 71 are separated from the short-circuit terminals 24 within the male connector housing 21, no closed circuit is formed. Therefore, in either state of FIGS. 6 and 7, complete fitting of the female connector housing 41 with the male connector housing 21 is not yet detected.

The male or female connector housing 21 or 41 is further relatively moved in the fitting direction, as illustrated in FIG. 8. The protrusion 84 of the locking member 81 is then moved over the protrusion 30 of the male connector housing 21 and reaches a position within the groove 27 as illustrated in FIGS. 1 and 2A. At this time, the locking member 81 returns upward because it is released from the downward pressure. The elastic portions 73 of the fitting detector terminal 71 also return upward attendant upon the locking member 81. In this state, the V-shaped portion of each elastic portion 73 is in contact with the corresponding short-circuit terminal 24 to form a closed circuit. Thus, complete fitting of the female connector housing 41 with the male connector housing 21 is detected.

In the state of FIG. 8, the distal end of each elastic portion 73 is positioned on the lower end of the corresponding recess 82*a* of the locking member 81, unlike the states of FIGS. 1, 6, and 7. This is because the elastic portion 73 is pressed downward by the corresponding short-circuit terminal 24 being in contact with the V-shaped portion of the elastic portion 73. In this state, each elastic portion 73 is in contact with the corresponding short-circuit terminal 24 with being biased upward.

To release the female connector housing 41 from the fitting with the male connector housing 21, the operation portion 82 of the locking member 81 is pressed downward and in this state, the male or female connector housing 21 or 41 is relatively pulled opposite to the fitting direction.

As described above, in the connector 1 of this embodiment, the locking member 81 that is displaced in the process of the fitting operation and engages with the male connector housing 21 to realize fitting is not formed integrally with the female connector housing 41. The locking member 81 is formed as a component separate from the female connector housing 41 and fixed to the fitting detector terminal 71. Therefore, in comparison with a case wherein the locking member 81 is formed integrally with the female connector housing 41, improvement of the fitting holding power can be easily realized without deteriorating the fitting operability. More specifically, in this embodiment, because the fitting holding power depends on the elastic force of the fitting detector terminal 71 supporting the locking member 81, it suffices if the elastic force of the fitting detector terminal 71 is regulated adequately.

In addition, the locking member 81 holds the elastic portions 73 of the fitting detector terminal 71 with being biased upward by the elastic force of the supporting portion 74 of the fitting detector terminal 71. Because the locking member 81 holds the elastic portions 73, movement of the elastic portions 73 together with the locking member 81 can be realized. Besides, because the locking member 81 is being biased upward, engagement of the protrusion 84 of the locking member 81 with the protrusion 30 of the male connector housing 21 is surer. This can improve the fitting holding power.

In addition, the locking member 81 has the recesses 82*a* for holding the distal ends of the elastic portions 73 of the fitting detector terminal 71. The distal end of each elastic portion 73 can be displaced within the corresponding recess 82*a*. More specifically, the distal end of each elastic portion 73 is at the upper end of the corresponding recess 82*a* in a state wherein the female connector housing 41 has not yet been completely fitted with the male connector housing 21 as illustrated in FIG. 1, 6, or 7. The distal end of each elastic portion 73 is at the lower end of the corresponding recess 82*a* in a state wherein the female connector housing 41 has been completely fitted with the male connector housing 21 as illustrated in FIG. 8. Even when the elastic portions 73 of the fitting detector terminal 71 are brought into contact with the short-circuit terminals 24 and displaced downward in the fitting process of the female connector housing 41 with the male connector housing 21, the locking member 81 is not pressed downward by the elastic portions 73. The locking member 81 is kept biased upward by the elastic force of the supporting portion 74 of the fitting detector terminal 71. Because the locking member 81 thus holds the elastic portions 73 of the fitting detector terminal 71 so as to be vertically displaceable, the balance of contacting force between the elastic portions 73 and the short-circuit terminals 24 to the fitting holding power can be kept good.

Further, in the locking member 81, a pair of elastic portions 73 of the fitting detector terminal 71 are supported from both of right and left sides within a pair of grooves 86 formed in the main body 83 of the locking member 81.

Therefore, in the operation of installing the fitting detector member 90 into the female connector housing 41, the operator can be prevented from touching the elastic portions 73 of the fitting detector terminal 71. Thus, the elastic portions 73 can be prevented from being deformed in the installing operation. For example, even if the operator holds the fitting detector member 90 from the sides, the operator never touches the elastic portions 73 of the fitting detector terminal 71 and therefore the elastic portions 73 can be prevented from being deformed.

Further, the interconnecting member 55 of the female connector housing 41 covers the V-shaped portions of the elastic portions 73 of the fitting detector terminal 71 with being kept at a vertical distance from the V-shaped portions. This can prevent the elastic portions 73 from being touched by the operator to be deformed in the fitting operation.

Further, the locking member 81 is made of resin. This can relieve a problem that the protrusion 30 of the male connector housing 21 is scraped in the fitting if operation of the female connector housing 41 with the male connector housing 21. Such a problem may be serious if the locking member is made of metal for example. In addition, the thickness of the operation portion 82 of the locking member 81 can be easily controlled upon molding the locking member 81 such that the operator feels no pain when the operator pushes the operation portion 82 by his or her finger. This can improve the operability.

When the locking member is formed integrally with the female connector housing 41, the locking member itself is bent in the process of the fitting operation. Therefore, the durability of the locking member comes into question. In this embodiment, however, because the locking member 81 is formed as a component separate from the female connector housing 41 and not the locking member 81 itself but the fitting detector terminal 71 is bent, the durability of the locking member is improved.

In a modification of the embodiment, the fitting detector member 90 may be installed in not the female connector housing 41 but the male connector housing 21.

The locking member 81 may not be made of resin.

In the above-described embodiment, the interconnecting member 55 of the female connector housing 41 covers the V-shaped portions of the elastic portions 73 of the fitting detector terminal 71 with being kept at a vertical distance from the V-shaped portions. In a modification, however, any part of the elastic portions 73 may not be covered with the female connector housing 41. That is, such an interconnecting member 55 may not be provided.

In the above-described embodiment, a pair of elastic portions 73 of the fitting detector terminal 71 is supported from both of right and left sides within a pair of grooves 86 formed in the main body 83 of the locking member 81. However, the present invention is not limited to this construction. That is, such grooves 86 may not be formed in the main body 83 of the locking member 81.

No recesses 82*a* may be formed in the operation portion 82 of the locking member 81.

The number of elastic portions 73 of the fitting detector terminal 71 is not limited to two. A single elastic portion 73 or three or more elastic portions 73 may be provided if they can be brought into contact with a pair of short-circuit terminals 24.

If the fitting detector terminal 71 has a structure that can come into contact with a pair of short-circuit terminals 24 when the female connector housing 41 is completely fitted with the male connector housing 21, the fitting detector terminal 71 may not have such elastic portions 73.

While this invention has been described in conjunction with the specific embodiments outlined above, it is evident that many alternatives, modifications and variations will be apparent to those skilled in the art. Accordingly, the preferred embodiments of the invention as set forth above are intended to be illustrative, not limiting. Various changes may be made without departing from the spirit and scope of the invention as defined in the following claims.

What is claimed is:

1. A connector comprising:

a male connector housing;

a female connector housing that can be fitted with the male connector housing;

a short-circuit terminal made of a conductive material and provided in one of the male and female connector housings;

a fitting detector terminal made of a conductive material and provided in the other of the male and female connector housings, the fitting detector terminal being displaced in a process of a fitting operation of the female connector housing with the male connector housing and coming into contact with the short-circuit terminal to form a closed circuit when the female connector housing is completely fitted with the male connector housing; and a locking member formed as a component separate from either of the male and female connector housings, the locking member being fixed to the fitting detector terminal and placed in the other of the male and female connector housings, the locking member being displaced together with the fitting detector terminal in the process of the fitting operation, the locking member being able to engage with the one of the male and female connector housings when the female connector housing is completely fitted with the male connector housing.

2. The connector according to claim 1, wherein the fitting detector terminal has an elastic portion that can be displaced perpendicularly to an extending direction thereof in the process of the fitting operation of the female connector housing with the male connector housing and comes into contact with the short-circuit terminal when the female connector housing is completely fitted with the male connector housing, and the locking member holds the elastic portion with being biased toward a direction in which the elastic portion comes close to the one housing when the female connector housing is completely fitted with the male connector housing.

3. The connector according to claim 2, wherein the locking member has a recess for holding an end of the elastic portion, and the end of the elastic portion can be displaced within the recess.

4. The connector according to claim 2, wherein the locking member supports at least part of the elastic portion from both sides perpendicularly to a direction in which the elastic portion can be displaced, and perpendicularly to the extending direction of the elastic portion.

5. The connector according to claim 2, wherein the other of the male and female connector housings covers at least part of the elastic portion with being kept at a distance in a direction in which the elastic portion can be displaced.

6. The connector according to claim 1, wherein the locking member is made of resin.

* * * * *